United States Patent [19]

Sando et al.

[11] 4,133,192

[45] Jan. 9, 1979

[54] APPARATUS FOR THE CONTINUOUS LIQUID PROCESSING OF CLOTH IN A HIGH PRESSURE STEAMER

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 838,396

[22] Filed: Sep. 30, 1977

Related U.S. Application Data

[62] Division of Ser. No. 776,911, Mar. 11, 1977.

[30] Foreign Application Priority Data

Mar. 18, 1976 [JP] Japan ..... 51-29526
Nov. 19, 1976 [JP] Japan ..... 51-39260

[51] Int. Cl.[2] ..... D06B 23/18
[52] U.S. Cl. ..... 68/5 E

[58] Field of Search ..... 68/5 D, 5 E, 205 R; 8/149.1

[56] References Cited

U.S. PATENT DOCUMENTS 2,532,471 12/1950 Wedler ..... 8/149.1 X

FOREIGN PATENT DOCUMENTS 2228440 1/1974 Fed. Rep. of Germany ..... 68/5 E

*Primary Examiner*—Philip R. Coe
*Attorney, Agent, or Firm*—Toren, McGeady and Stanger

[57] ABSTRACT

An apparatus for continuous liquid processing having either a mechanism which has a number of nozzle groups provided within a high pressure steamer and a cover which is so provided around the nozzle groups with the cloth to be treated passing through the group, or a nozzle mechanism provided in a preheating chamber within the high pressure steamer for spraying the processing liquid.

1 Claim, 6 Drawing Figures

APPARATUS FOR THE CONTINUOUS LIQUID PROCESSING OF CLOTH IN A HIGH PRESSURE STEAMER

This is a division of application Ser. No. 776,911 filed Mar. 11, 1977.

BACKGROUND OF THE INVENTION

The present invention relates to an apparatus for impregnating cloth to be treated such as round drum cloth, etc., with processing liquid such as dyestuff liquid, etc. in a high pressure steamer vessel, in a sufficient and uniform manner for conducting high humidity and high temperature treatment of the cloth.

In a similar conventional treatment of cloth, when the cloth being treated is round drum cloth, stitched or woven in a tubular shape, it is treated with a processing liquid such as a dyestuff liquid by dipping the cloth in the liquid stored in a liquid tank for impregnating the cloth with processing liquid, then, after adjusting the amount of the processing liquid impregnated to a prescribed amount by squeezing the cloth with squeezing rolls, conducting a heat treatment, or dipping the cloth being treated in the liquid tank located outside a high pressure steamer, and then introducing the cloth into the high pressure steamer vessel where a high humidity and high temperature state is maintained for conducting liquid treatment.

This conventional treatment has the shortcoming such that the round drum cloth being impregnated with dyestuff liquid has the liquid squeezed by squeezing rolls and crease marks are generated at hem of the cloth in the high pressure steamer thus dyeing specks are formed in linear shape. Further, since the treating liquid, such as a dyestuff liquid, sticks to the surface of the squeezing rolls in a high pressure steamer which is made nowadays in a large scale, staining the surface, it is necessary to clean the surfaces frequently or every time the liquid is replaced, thus consuming time and man power with a lowering of productivity.

While an apparatus has been proposed in which the processing liquid is applied to the cloth after it has passed through rubber sealing rolls of a high pressure steamer sealing mechanism for eliminating the above mentioned shortcoming, in such apparatus the processing liquid tank is located at a position within the high pressure steamer vessel interiorly of the pressure contacting part of the sealing rubber rolls, therefore, even if the staining of the sealing rolls surfaces can be avoided, there is the necessity to clean the inside of the liquid tank every time the processing liquid is replaced, further the processing liquid tank is provided within the steamer vessel and can not be viewed from the outside, thus having such inconvenience that the degree of stain in the tank can only be estimated, and sometimes results in incomplete cleaning.

SUMMARY OF THE INVENTION

The present invention is to provide an apparatus for the continuous liquid treatment of a cloth which can eliminate the shortcomings of the conventional apparatus and can impregnate a cloth with a prescribed amount of dyestuff liquid or other processing liquid within a high pressure steamer vessel for conducting a high degree of treatment such as dyeing.

In accordance with the present invention an apparatus is made so that an inlet and an outlet for a cloth to be treated each have a sealing mechanism formed on a high pressure steamer vessel and a liquid coating mechanism is provided near the inlet within the vessel. Further a number of guide rolls provide a zigzag shaped transport of the cloth between the coating mechanism and the outlet and dancer rolls are arranged to give the appropriate amount of tension to the cloth during its transport. A cover is disposed around the liquid coating mechanism so that the cloth passes through it in the downward direction. Spray nozzles for blowing the treatment liquid onto both surfaces of the cloth are positioned inside of the cover in parallel multi-layers, while a liquid receiving and storage tank is provided at a bottom of the cover, so that the liquid from the receiving and storage tank can be re-sprayed from the spray nozzles by the driving force of a pump.

Another type of apparatus useful in the present invention, includes a sealing mechanism positioned at the inlet of a cloth into a high pressure steamer vessel, and the sealing mechanism consists of a cloth passage extending into the vessel, a pair of rubber sealing rolls closing an external opening of the passage to the outside of the steamer, end plane sealing plates, and a pair of gap rolls provided at the end of the passage to the inside of the steamer having a gap maintained therebetween, and a pre-heating chamber formed within the cloth passage by valve seats in multi-layers with reducing exhaust pipes connected to the pre-heating chamber. Further, elastic sealing plates, pressurized air blow-in tubes and pressurized water feed tubes, are provided at the sealing mechanism, especially processing liquid spray nozzles arranged in parallel multi-layers within the pre-heating chamber.

The various features of novelty which characterize the invention are pointed out with particularity in the claims annexted to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
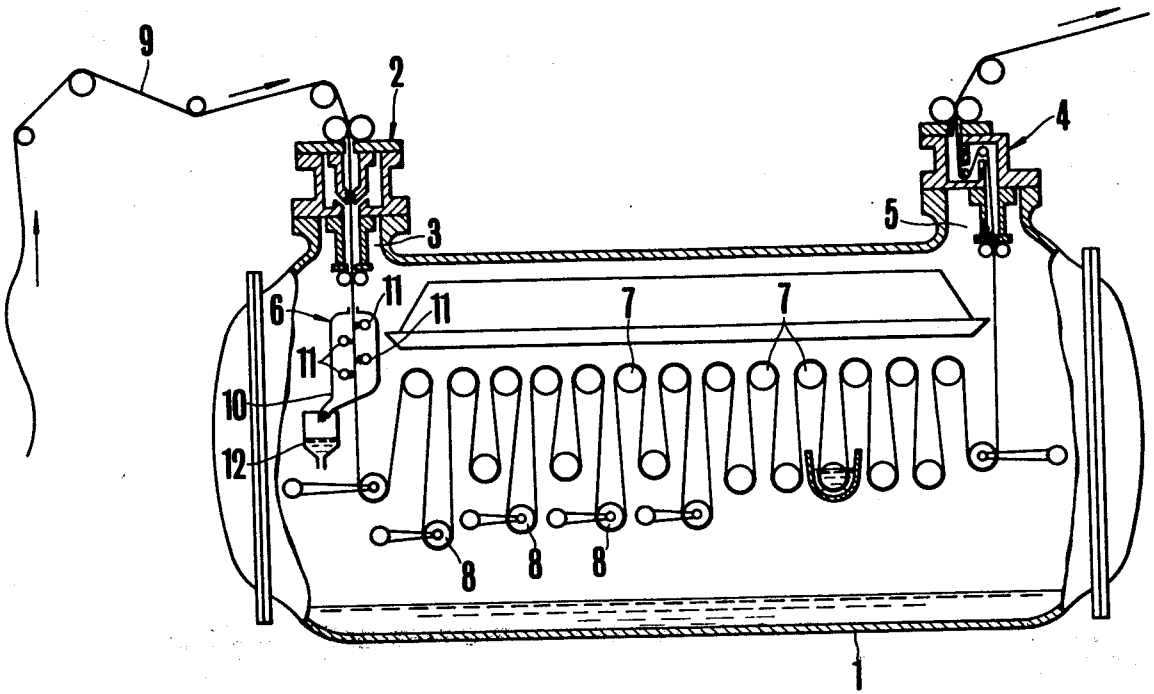
FIG. 1 is a vertical cross-sectional view of the interior of a liquid processing apparatus in accordance with the present invention.

In FIG. 1 a high pressure steamer vessel (1) is shown in which a high pressure humid temperature up to about 5 kg/cm$^2$, 160° C is maintained, and an inlet sealing mechanism (2) is provided at an inlet (3) for cloth to be processed in the steamer vessel (1) while an outlet sealing mechanism (4) is provided at a cloth outlet (5) from the vessel (1). A coating mechanism (6) for a processing liquid such as a dyestuff liquid, etc. is provided near the cloth inlet (3) within the steamer vessel (1), and a number of guide rolls (7) are provided for transporting the cloth in a zigzag manner between the processing liquid coating mechanism (6) and the cloth outlet (5) from the steamer vessel (1). Further, a plurality of dancer rolls (8) spaced from and in parallel with the guide rolls are positioned to give an appropriate amount of tension to the cloth traveling over the rolls.

Figure 2A:
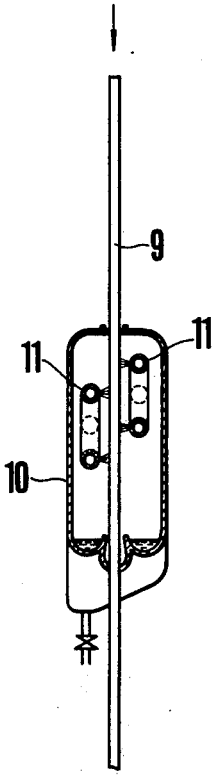
FIGS. 2(*a*), (*b*) and (*c*) are a side elevation, a plan, and a front elevation, respectively, illustrating on an enlarged scale an important part of the apparatus in FIG. 1.
Figure 2B:
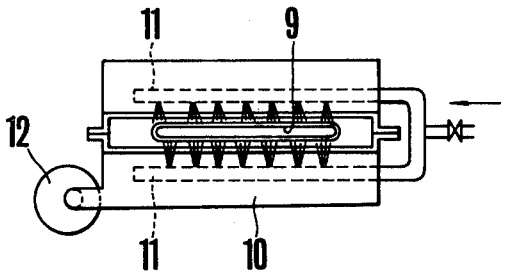
Figure 2C:
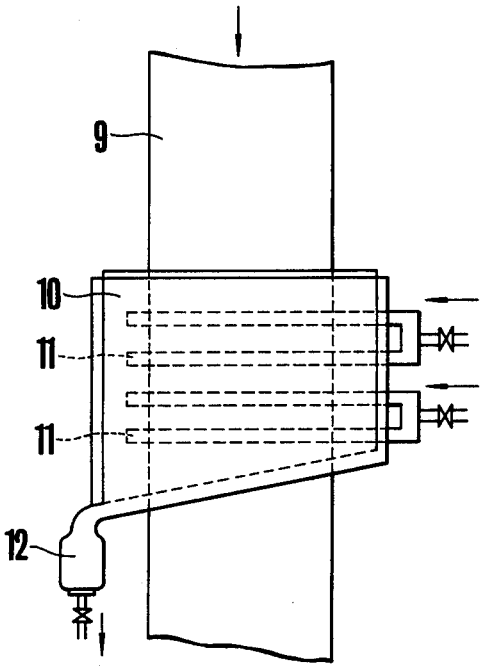

FIGS. 2(*a*), (*b*) and (*c*) are a side elevation, a plan and a front elevation, respectively, disclosing in an enlarged manner, details of the processing liquid coating mechanism (6) which constitutes the present invention.

In each of these Figs., processing liquid spray nozzles (11) directed toward both surfaces of a cloth (9) to be processed, are provided in parallel multi-layers within a cover (10) through which the cloth (9) passes downwardly, and a processing liquid receiving and storage tank (12) is located at the bottom of the cover (10) so that the processing liquid stored in the tank (12) is fed to the spray nozzles (11) by a driving mechanism such as a pump, (not shown in the drawing) for re-using the liquid.

Since a cloth to be processed is coated and impregnated with the processing liquid by the spray system as shown in this example, there is the advantage that the cloth can be continuously coated and impregnated with a desired amount of processing liquid by adjusting both the amount of the processing liquid sprayed from the nozzles and the transporting speed of the cloth.

Further, there is the special feature that the inside of the cover (10) is filled with vaporized processing liquid by providing the nozzles in a great number and by enclosing the nozzles with the cover (10), thus the surface of the cloth passing through said cover (10) can be impregnated with a uniform and prescribed amount of processing liquid.

Therefore, the present invention has the advantage that a cloth being processed can have a desired amount of processing liquid impregnated therein without providing squeezing rolls, eliminating processing specks by crease marks which take place frequently in conventional processing operations, thus uniform processing of cloth, such as round drum cloth, etc., can be done.

Figure 3:
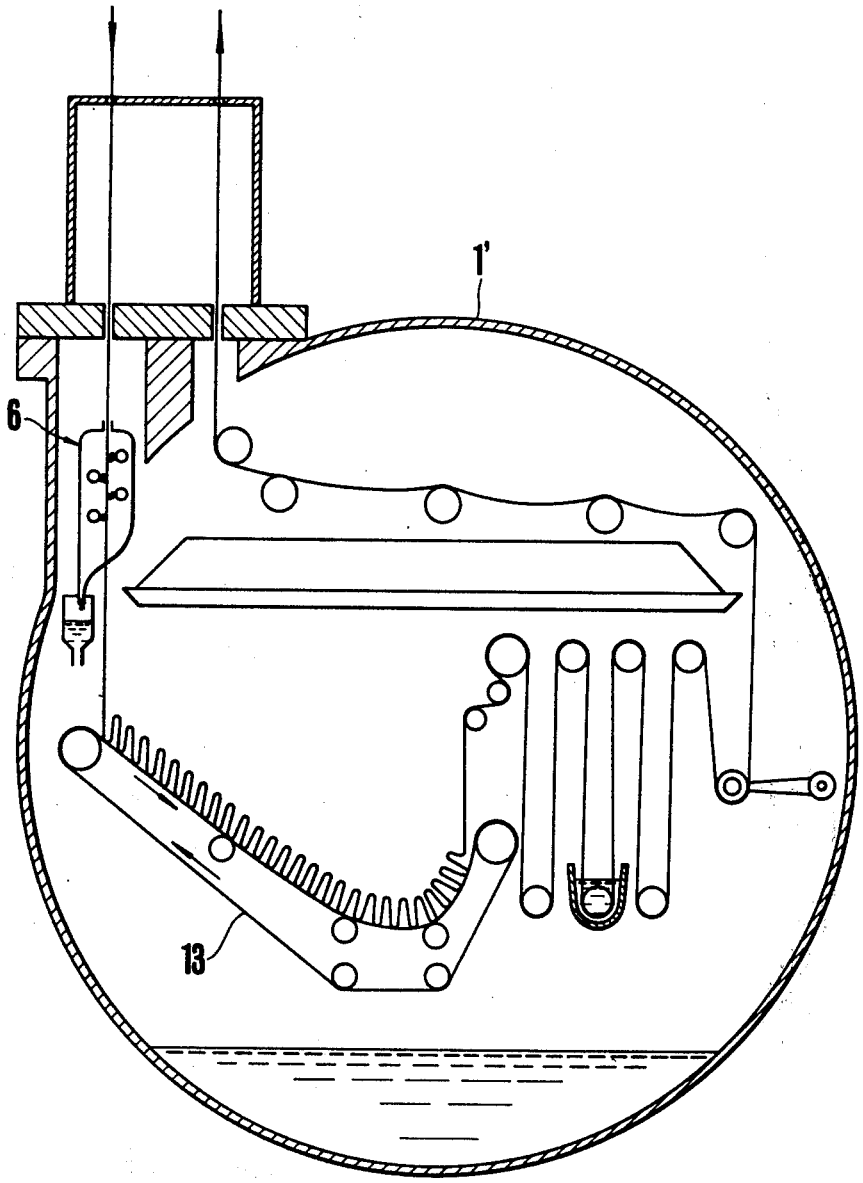
FIG. 3 is a cross-sectional view showing in cross section a part of another liquid processing apparatus embodying the present invention.

Next, another embodiment of the present invention is shown in FIG. 3. A slanted endless conveyor (13) is provided within a steamer vessel (1'), and a cloth to be impregnated with a prescribed amount of processing liquid (dyestuff liquid, etc.) is conveyed through a processing liquid coating mechanism (6) surrounded by a cover in which humidity-heat processing is carried out while the timing of the operation is suitably adjusted by the conveyor (13), so that the processing liquid (dyestuff, etc.) is completely fixed. However, since the structure of the steamer vessel (1') is not a part of the present invention, the detailed explanation thereof will be omitted. A roller conveyor or conveyors can be used in place of the endless conveyor.

In this example, since the cloth is coated and impregnated with processing liquid by a spray system, the cloth does not require a pressurized squeezing of liquid, yet the cloth, such as a round drum cloth, can be continuously coated and impregnated with a prescribed amount of processing liquid on all of its surface without developing any specks, by adjusting the amount of the processing liquid sprayed from the nozzles. Therefore, similar advantages and special features as in the first example mentioned above can be obtained, and the intended object can be achieved.

Figure 4:
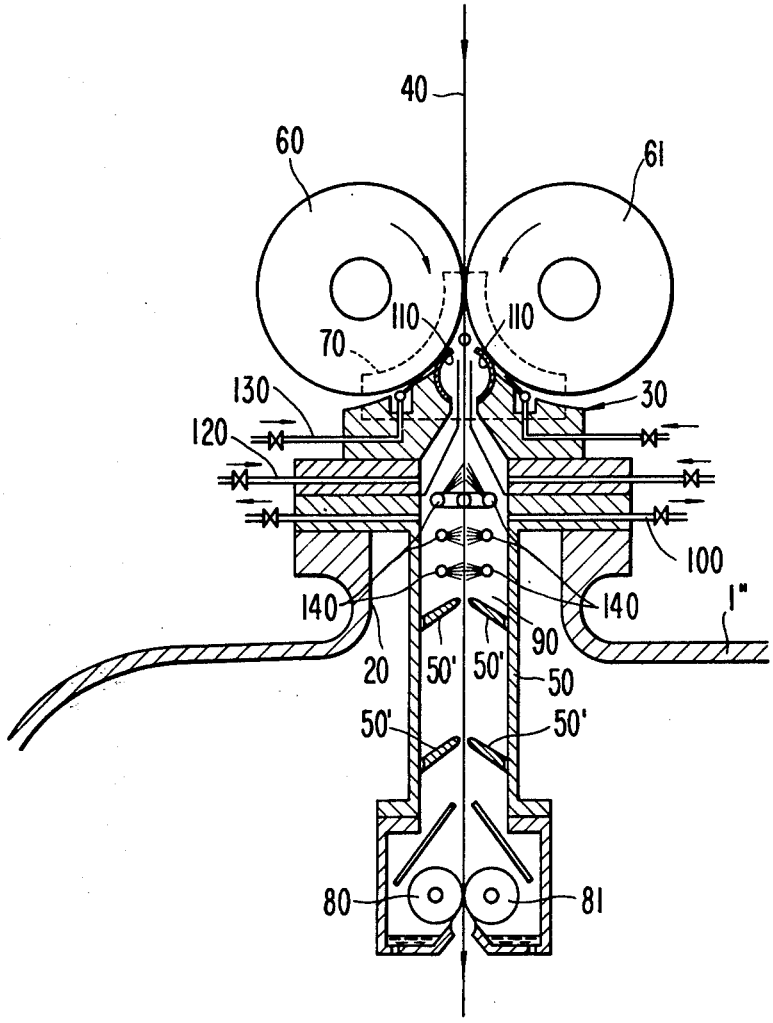
FIG. 4 is a vertical cross-sectional view of still another liquid processing apparatus embodying the present invention.

In the third example shown in FIG. 4, an inlet sealing mechanism (30) located at cloth inlet (20) to high pressure steamer vessel (1'') allows a cloth (40) being processed to pass therethrough and has the function of preserving the high pressure heat within the vessel (1''). The sealing mechanism (30) includes a cloth passage (50) extending into the vessel (10), a pair of rubber sealing rolls (60), (61) and end sealing plate (70) close the opening from the cloth passage (50) to outside of the steamer. A pair of gap rolls (80), (81), are positioned at the inner end of the cloth passage (50) which opens into the steamer and the gap rolls have a spacing of 0.5 to 2 mm therebetween. A pre-heating chamber (90) is formed within the cloth passage (50) and is subdivided by opposing valve seats (50') for reducing in multi-step manner, the temperature within the steamer vessel (1''), for example, 160° C, to a lower temperature of 130° C to 60° C, and reduction exhaust tubes (100) are connected through the passage (50) to the pre-heating chamber (90). In addition to the components mentioned above, the sealing mechanism (30) includes elastic sealing plates (110), pressurized air blow-in tubes (120), and pressurized water feeding tubes (130). However, since the structure of the sealing mechanism (30) is not a part of the present invention, a detailed description of its component parts and their function is omitted.

In FIG. 4, spray nozzles (140) direct processing liquid toward both surfaces of the cloth (40) and are arranged in parallel with the pre-heating chamber (90). Therefore, the processing liquid is sprayed from spray nozzles (140) onto the cloth (40) after it passes through the pair of sealing rolls (60), (61), for coating and impregnating the cloth with the liquid, therefore, the surfaces of the sealing rolls (60), (61) will not be stained by processing liquid impregnated into the cloth. Further, the processing liquid will not be squeezed out by the pressure contacting force of the sealing rolls, thus, an effective processing operation is afforded for the humid heat treatment of cloth impregnated with a prescribed amount of processing liquid.

Further, as the spray nozzles (140) are provided within the pre-heating chamber (90) which is maintained at a temperature (for example a chamber temperature of about 80° C) lower than the temperature (for example 160° C) within the steamer vessel, the processing liquid is sprayed by the spray nozzles (the blowing pressure of the liquid is about 8 kg/cm$^2$) onto the cloth very effectively, yet the processing liquid sprayed on the cloth within the pre-heating chamber (90) is in a state containing the prescribed humid heat, thus there are the advantages that coating can be done without specks and processing liquid can be impregnated uniformly.

What is claimed is:

1. A continuous liquid processing apparatus for cloth comprising a high pressure steamer vessel having a cloth inlet, a sealing mechanism mounted on said steamer at the cloth inlet and forming an elongated laterally closed cloth passage having an external opening to said passage on the exterior of said steamer and an interior opening from said passage into the interior of said steamer a pair of rubber sealing rolls closing the external opening of said passage, end plane sealing plates positioned at the opposite ends of said sealing rolls, gap rolls provided at the interior opening of said cloth passage, elastic sealing plates located in said cloth passage adjacent the exterior opening and in contact with said sealing rolls, pressurized air blow-in tubes and pressurized water feeding tubes connected to said sealing mechanism and opening into said cloth passage wherein the improvement comprises that said cloth passage forms a pre-heating chamber, a plurality of valve-seats provided in opposed relation and in a multi-step arrangement within said cloth passage and subdividing said pre-heating chamber, reducing exhaust tubes are connected to said pre-heating chamber, and processing liquid spray nozzles spaced apart in the elongated direction of said cloth passage and disposed in a parallel multi-step arrangement within said pre-heating chamber so that said nozzles face both surfaces of the cloth passing through said passage.

* * * * *